US009693149B2

(12) United States Patent
Yoo et al.

(10) Patent No.: US 9,693,149 B2
(45) **Date of Patent: *Jun. 27, 2017**

(54) MICROPHONE AND METHOD FOR MANUFACTURING THE SAME

(71) Applicant: Hyundai Motor Company, Seoul (KR)

(72) Inventors: Ilseon Yoo, Seoul (KR); Hyunsoo Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 109 days.

This patent is subject to a terminal disclaimer.

(21) Appl. No.: 14/551,014

(22) Filed: Nov. 23, 2014

(65) Prior Publication Data

US 2016/0088400 A1 Mar. 24, 2016

(30) Foreign Application Priority Data

Sep. 23, 2014 (KR) ..... 10-2014-0126788

(51) Int. Cl.
*H04R 21/02* (2006.01)
*H04R 17/02* (2006.01)
*H04R 31/00* (2006.01)

(52) U.S. Cl.
CPC ..... *H04R 17/02* (2013.01); *H04R 31/00* (2013.01)

(58) Field of Classification Search
USPC ..... 381/190
See application file for complete search history.

(56) References Cited

U.S. PATENT DOCUMENTS

2005/0069164 A1* 3/2005 Muthuswamy ..... H04R 19/04 381/369

FOREIGN PATENT DOCUMENTS

| | | | |
|---|---|---|---|
| JP | 2007-013509 | A | 1/2007 |
| JP | 2009-038732 | A | 2/2009 |
| JP | 4355273 | B2 | 10/2009 |
| JP | 5108533 | B2 | 12/2012 |
| KR | 10-0873094 | | 12/2008 |
| KR | 10-2010-0071607 | A | 6/2010 |
| KR | 10-2011-0025697 | | 3/2011 |
| KR | 10-2013-0091773 | | 8/2013 |

* cited by examiner

*Primary Examiner* — Amir Etesam
(74) *Attorney, Agent, or Firm* — Mintz Levin Cohn Ferris Glovsky and Popeo, P.C.; Peter F. Corless

(57) ABSTRACT

A microphone and method for manufacturing the microphone are provided. The microphone includes a substrate with a penetration aperture, a vibration unit disposed on the substrate to cover the penetration aperture, and a fixed electrode disposed over, and spaced from, the vibration unit. Further, the vibration unit includes a first portion and a second portion disposed on the penetration aperture, and a third portion disposed on the substrate. In addition, the first portion and the third portion are spaced from each other, and the second portion is connected between the first portion and the third portion, and includes a first piezoelectric portion and a second piezoelectric portion.

8 Claims, 7 Drawing Sheets

MICROPHONE AND METHOD FOR MANUFACTURING THE SAME

CROSS-REFERENCE TO RELATED APPLICATION

This application claims priority to and the benefit of Korean Patent Application No. 10-2014-0126788 filed on Sep. 23, 2014, the entire contents of which are incorporated herein by reference.

BACKGROUND (a) Field of the Invention

The present invention relates to a microphone and a method for manufacturing the same.

(b) Description of the Related Art

A microphone, which converts a sound wave into an electric signal, may be manufactured in a decreased size by using Micro Electro Mechanical System (MEMS) technology. The MEMS microphone is more resistant to heat and humidity than an Electret Condenser Microphone (ECM), which allows integration with a signal processing circuit.

A high performance microphone, an Acoustic Overload Point (AOP), a sensitivity of the microphone and a Signal-to-Noise Ratio (SNR) may have advantages and disadvantages related to one another. A high sensitivity microphone may not be able to sense a substantially loud sound due to a low AOP. However, a low sensitivity microphone may sense the substantially loud sound due to a high AOP, so the low sensitivity microphone may not detect a substantially low sound.

The above information disclosed in this section is merely for enhancement of understanding of the background of the invention and therefore it may contain information that does not form the prior art that is already known in this country to a person of ordinary skill in the art.

SUMMARY

The present invention provides a microphone and a method for manufacturing the same that may improve a sound pressure measuring range of a microphone. The present invention provides a microphone that may include a substrate, which may include a penetration aperture, a vibration unit disposed on the substrate to cover the penetration aperture, and a fixed electrode disposed over and spaced from the vibration unit. Further, the vibration unit may include a first portion and a second portion disposed over the penetration aperture, and a third portion disposed on the substrate, wherein the first portion and the third portion may be spaced from each other, and the second portion may be connected between the first portion and the third portion and may include a first piezoelectric portion and a second piezoelectric portion.

Each of the first portion, the second portion, and the third portion may each include a first insulation film, a second insulation film, and a vibration film disposed between the first insulation film and the second insulation film. The first piezoelectric portion may be disposed on an underside (e.g., a bottom surface) of the first insulation film, and the second piezoelectric portion may be disposed on the second insulation film. Further, the first piezoelectric portion may include a first piezoelectric lower electrode, a first piezoelectric upper electrode, and a first piezoelectric layer disposed between the first piezoelectric lower electrode and the first piezoelectric upper electrode. The second piezoelectric portion may include a second piezoelectric lower electrode, a second piezoelectric upper electrode and a second piezoelectric layer disposed between the second piezoelectric lower electrode and the second piezoelectric upper electrode. The vibration film may be formed of polysilicon or a conductive material. In addition, the substrate may be formed of silicon. The microphone may further include a supporting layer disposed on the third portion and configured to support the fixed electrode.

The present invention also provides a method for manufacturing a microphone that may include forming a recess within a substrate, forming an oxide film on the substrate, forming a vibration unit on the oxide film; forming a fixed electrode that may include a plurality of air inlets over and spaced from the vibration unit, and etching a back side of the substrate and the oxide film to form a penetration aperture, which exposes a portion of the vibration unit. The vibration unit may include a first portion and a second portion disposed over the penetration aperture, and a third portion disposed on the substrate, wherein the first portion and the third portion may be spaced from each other, and the second portion may be connected between the first portion and the third portion, and may include a first piezoelectric portion and a second piezoelectric portion.

The forming of a vibration unit may include forming the first piezoelectric portion on the oxide film within the recess, forming a first insulation film, a vibration film, and a second insulation film on the oxide film and the first piezoelectric portion, patterning the first insulation film, the vibration film, and the second insulation film, and forming the second piezoelectric portion on the second insulation film at a position opposite of the first piezoelectric portion.

The forming of a fixed electrode may include forming a sacrificial layer on the vibration unit, forming a metal layer on the sacrificial layer and patterning the metal layer, and removing a portion of the sacrificial layer. The substrate may be formed of silicon.

Thus, the microphone in accordance with an exemplary embodiment of the present invention may have the following advantages. The piezoelectric portions disposed within the vibration unit may limit the stress applied to the piezoelectric portion and enable active detection of the sound based on the height of the sound pressure of the sound being introduced thereto from an exterior of the microphone. The microphone may improve a measuring range of the sound based on the height of the sound pressure of the sound applied thereto from an exterior of the microphone.

BRIEF DESCRIPTION OF THE DRAWINGS

The above and other features of the present invention will now be described in detail with reference to certain exemplary embodiments thereof illustrated in the accompanying drawings which are given herein below by way of illustration only, and thus are not limitative of the present invention, and wherein.

DETAILED DESCRIPTION

Figure 1:
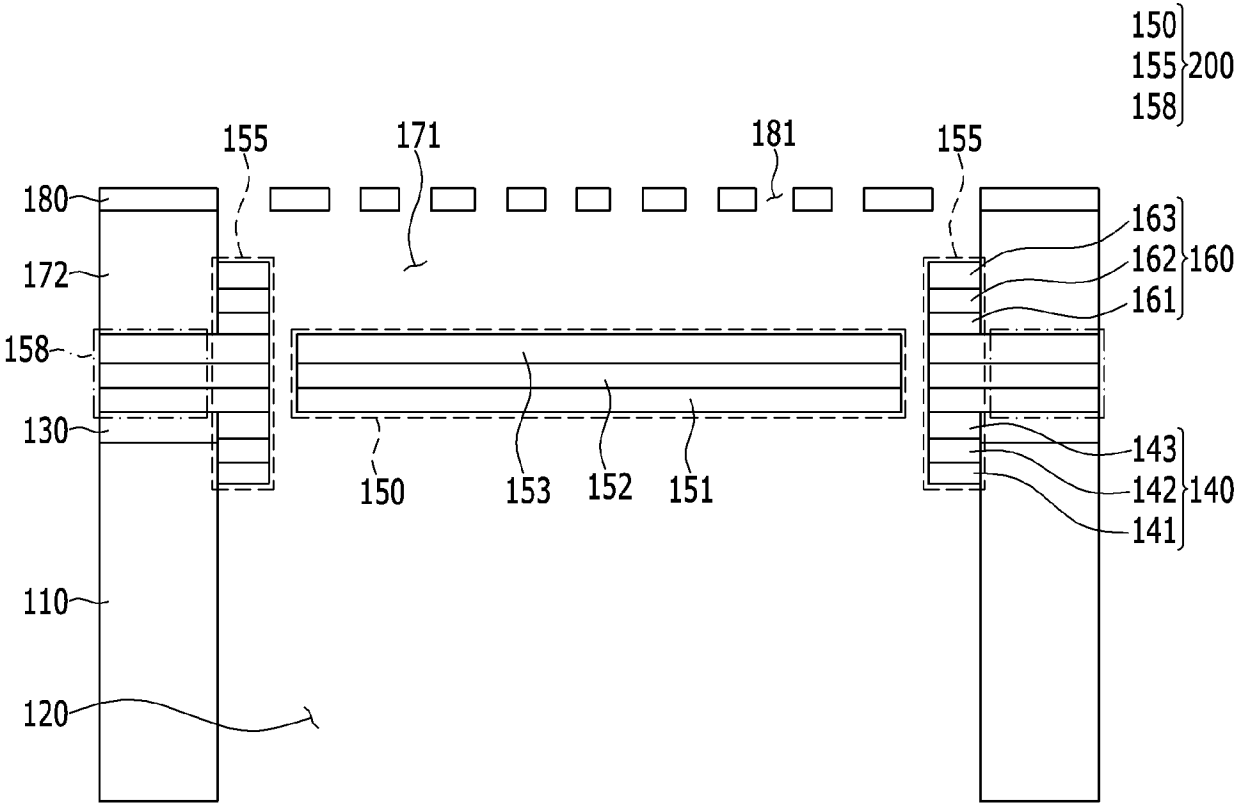
FIG. 1 illustrates an exemplary schematic cross sectional view of a microphone according to an exemplary embodiment of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Exemplary embodiments of the present invention will be described with reference to the accompanying drawings, in detail. However, the present invention is not limited to the exemplary embodiments, but may be embodied in other modes. On the contrary, the exemplary embodiments disclosed herein are provided for making disclosures of the present invention introduced herein, and forwarding aspects of the present invention to a person of an ordinary skill in the art, adequately.

In the drawings, thicknesses of layers and regions are exaggerated for clarity. In addition, when it is described that a layer is "on" other layer or substrate, the layer may be formed on the other layer or the substrate, or a third layer may be interposed between the layer and the other layer or the substrate.

Figure 2:
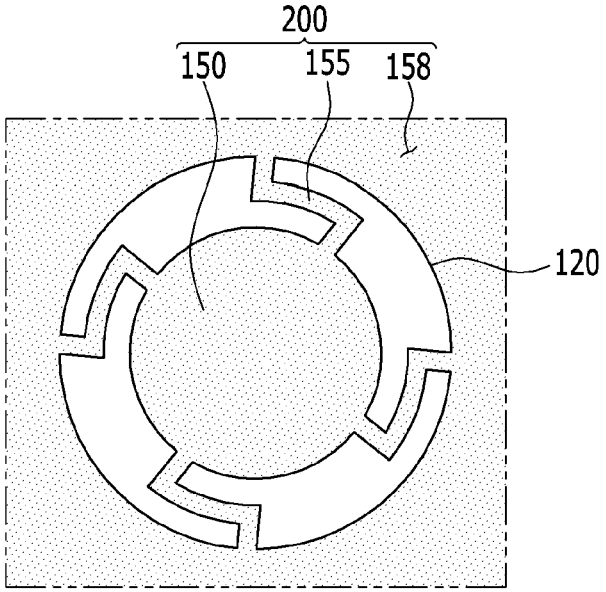
FIG. 2 illustrates an exemplary top schematic view of the vibration unit in the microphone in FIG. 1 according to an exemplary embodiment of the present invention.

Referring to FIGS. 1 and 2, the microphone in accordance with an exemplary embodiment of the present invention will be described. FIG. 1 illustrates an exemplary schematic cross sectional view of a microphone according to an exemplary embodiment of the present invention, and FIG. 2 illustrates an exemplary top schematic view of the vibration unit in the microphone in FIG. 1 according to an exemplary embodiment of the present invention. Referring to FIGS. 1 and 2, the microphone may include a substrate 110, a vibration unit 200 and a fixed electrode 180. The substrate 110 may be formed of silicon, and have a penetration aperture 120 formed therein.

The vibration unit 200 may be disposed on the substrate 110. Further, the vibration unit 200 may cover the penetration aperture 120. An oxide film 130 may be disposed between the substrate 110 and the vibration unit 200. The vibration unit 200 may include a first portion 150, a second portion 155, and a third portion 158. The first portion 150 and the third portion 158 may be spaced apart from each other. In addition, the first portion 150 may be disposed over the penetration aperture 120, and the third portion 158 may be disposed over the substrate 110. The second portion 155 may be disposed on the penetration aperture 120 and connected between the first portion 150 and the third portion 158.

The first portion 150 and the third portion 158 may each include a first insulation film 151, a vibration film 152, and a second insulation film 153. The vibration film 152 may be formed of polysilicon. Moreover, a material of the vibration film 152 may not be limited to this, but the vibration film 152 may be formed of a material that has conductivity (e.g., is able to conduct electricity). The vibration film 152 may be disposed between the first insulation film 151 and the second insulation 153. Within the third portion 158, the first insulation film 151 may be disposed on the oxide film 130. The second portion 155 may include the first insulation film 151, the vibration film 152, and the second insulating film 153. The second portion 155 may also include a first piezoelectric portion 140, and a second piezoelectric portion 160.

The first piezoelectric portion 140 may be disposed on an underside (e.g., a bottom side) of the first insulation film 151, and include a first piezoelectric lower electrode 141, a first piezoelectric layer 142, and a first piezoelectric upper electrode 143. The first piezoelectric layer 142 may be formed of a piezoelectric material (e.g., lead zirconate titanate (PZT), barium titanate ($BaTiO_3$), and Rochelle salt) disposed between the first piezoelectric lower electrode 141 and the first piezoelectric upper electrode 143. The first piezoelectric upper electrode 143 may contact the first insulation film 151 (e.g., may be formed adjacent to).

The second piezoelectric portion 160 may be disposed on the second insulation film 153 and include a second piezoelectric lower electrode 161, a second piezoelectric layer 162 and a second piezoelectric upper electrode 163. The second piezoelectric layer 162 may be formed of a piezoelectric material (e.g., lead zirconate titanate (PZT), barium titanate ($BaTiO_3$), and Rochelle salt) disposed between the second piezoelectric lower electrode 161 and the second piezoelectric upper electrode 163. The second piezoelectric lower electrode 161 may contact the second insulation film 153.

Portions of the vibration unit 200 (e.g., the first portion 150 and the second portion 155) may be exposed by the penetration aperture 120 within the substrate 110. The first portion 150 and the second portion 155 may be configured to vibrate in response to a sound applied thereto from an exterior of the microphone. Over the vibration unit 200, the fixed electrode 180 may be spaced from the vibration unit 200. The fixed electrode 180 may be disposed on a supporting layer 172 fixedly secured thereto. The supporting layer 172 may be disposed on the third portion 158 of the vibration unit 200 configured to support the fixed electrode 180.

An air layer 171 may be formed between the fixed electrode 180 and the first portion 150 and the second portion 155 of the vibration unit 200, that spaces the fixed electrode 180 a predetermined distance from the first portion 150 and the second portion 155 of the vibration unit 200. Additionally, the fixed electrode 180 may have a plurality of air inlets 181 disposed therein. A sound from an exterior of the microphone may be introduced through the air inlets 181 to stimulate the vibration unit 200, and cause the vibration unit 200 vibrate. In particular, the first portion 150 and the second portion 155 of the vibration unit 200 disposed on the penetration aperture 120 may be configured to vibrate.

As the first portion 150 and the second portion 155 of the vibration unit 200 vibrate, a space between the first portion 150 and the fixed electrode 180 may change. Accordingly, capacitance between the vibration film 152 of the first portion 150 and the fixed electrode 180 may change, and the capacitance change may be forwarded to a signal processing circuit (not shown) via a pad connected to the vibration unit 200 and converted into an electric signal at the signal processing circuit (not shown), which enables the sound from the exterior of the microphone to be detected. The second portion 155 of the vibration unit 200 may include the first piezoelectric portion 140 and the second piezoelectric portion 160, configured to apply stress to the second portion 155 of the vibration unit 200 selectively, adjusting stiffness of the second portion 155 of the vibration unit 200.

The sound from the exterior may be a substantially loud or a substantially quiet sound. When the sound is a substantially loud sound (e.g., a sound pressure introduced from the exterior is substantially high that is greater than a predetermine pressure), the sound may be detected by measuring the change of the capacitance between the vibration film 152 of the first portion 150 and the fixed electrode 180 caused by the change of the space between the first portion 150 of the vibration unit 200 and the fixed electrode 180. When the sound is a substantially quiet sound (e.g., the sound pressure introduced from the exterior is substantially low), a voltage may be applied to the first piezoelectric portion 140 and the second piezoelectric portion 160.

When voltage is applied to the first piezoelectric portion 140, the voltage may be applied to the first piezoelectric lower electrode 141 and the first piezoelectric upper electrode 143. Accordingly, the stress may be applied to the first piezoelectric layer 142. When the voltage is applied to the second piezoelectric portion 160, the voltage may be applied to the second piezoelectric lower electrode 161 and the second piezoelectric upper electrode 163. Accordingly, the stress may be applied to the second piezoelectric layer 162. Since the first piezoelectric portion 140 and the second piezoelectric portion 160 are insulated from the vibration film 152 by the first insulation film 151 and the second insulation film 153 electrically, the application of the voltage may not influence to the vibration film 152.

When stress is applied to the first piezoelectric portion 140 and the second piezoelectric portion 160, a spring constant of the second portion 155 may be reduced, which may reduce a resonance frequency. Accordingly, a substantially quiet sound may be more easily detected by measuring the variation of the capacitance between the vibration film 152 of the first portion 150 and the fixed electrode 180.

Since the second portion 155 of the vibration unit 200 may include the first piezoelectric portion 140 and the second piezoelectric portion 160, the sound may be actively detected based on a height of the sound pressure introduced from the outside. Eventually, the microphone may improve a measuring range of the sound based the height of the sound pressure.

Figure 3:
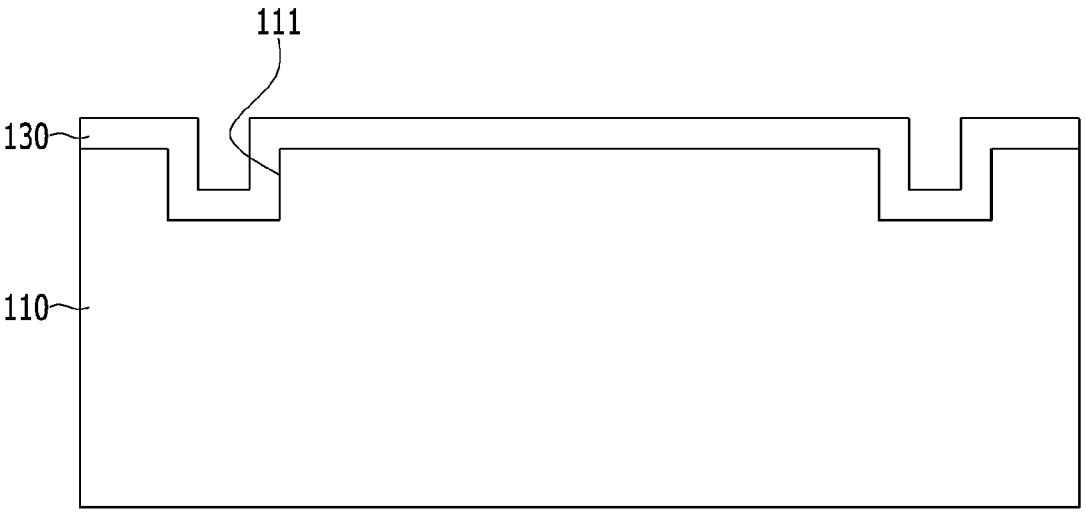
FIGS. 3 to 7 illustrate exemplary drawings showing the steps of a method for manufacturing a microphone according to an exemplary embodiment of the present invention.

A method for manufacturing a microphone according to an exemplary embodiment of the present invention will be described with reference to FIGS. 3 to 7. FIGS. 3 to 7 illustrate exemplary drawings showing a method for manufacturing a microphone according to an exemplary embodiment of the present invention. Referring to FIG. 3, after providing a substrate 110, a plurality of recesses 111 may be formed within the substrate 110. An oxide film 130 may also be formed on the substrate 110. The substrate 110 may be formed of silicon.

Figure 4:
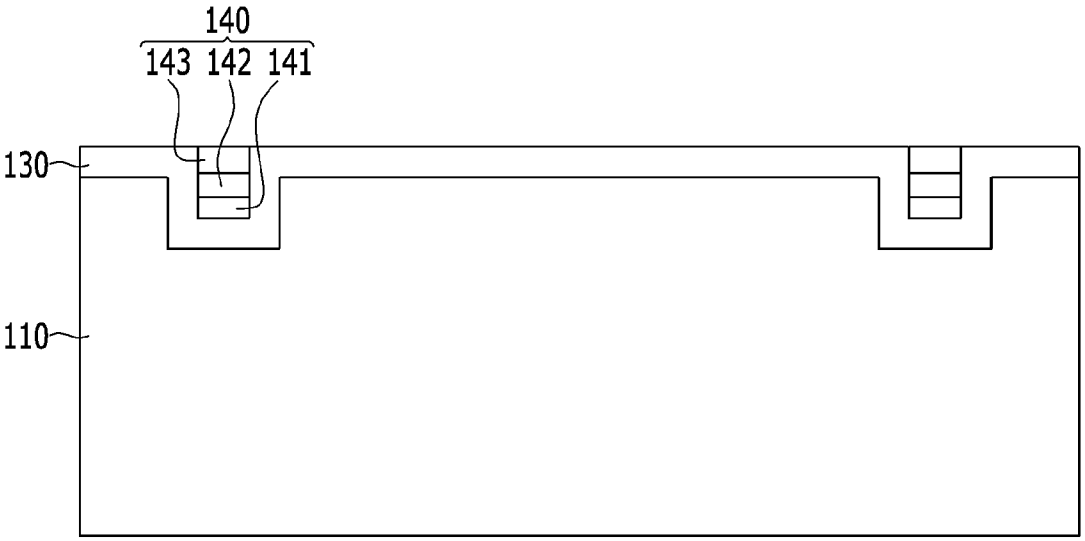

Referring to FIG. 4, a first piezoelectric portion 140 may be formed on the oxide film 130 to include a first piezoelectric lower electrode 141, a piezoelectric layer 142 and a first piezoelectric upper electrode 143. The first piezoelectric portion 140 may be formed on the oxide film 130 within the recess 111 of the substrate 110. The first piezoelectric portion 140 may be formed by forming the first piezoelectric lower electrode film 141, the piezoelectric film 142 and the first piezoelectric upper electrode film 143 on the oxide film 130 in succession, and patterning the first piezoelectric lower electrode film 141, the piezoelectric layer 142 and the first piezoelectric upper electrode film 143. The first piezoelectric film may formed of a piezoelectric material (e.g., lead zirconate titanate (PZT), barium titanate ($BaTiO_3$), and Rochelle salt).

Figure 5:
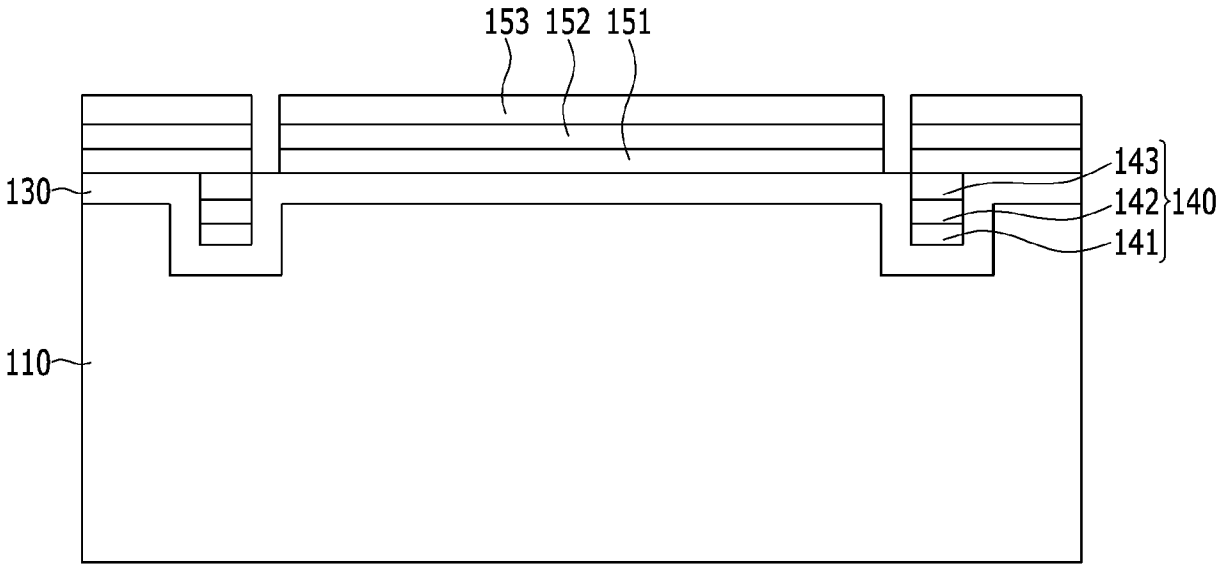

Referring to FIG. 5, a first insulating film 151, a vibration film 152, and a second insulation film 153 may be formed on the oxide film 130 and the piezoelectric portion 140 in succession. The vibration film 152 may be formed of polysilicon. Moreover, the material of the vibration film 152 is not limited thereto, but may be formed of a material that has conductivity (e.g., is capable of conducting electricity). The first insulation film 151, the vibration film 152, and the second insulation film 153 may be patterned to form a first portion 150, a second portion 155, and a third portion 158 of the vibration unit 200, respectively.

Figure 6:
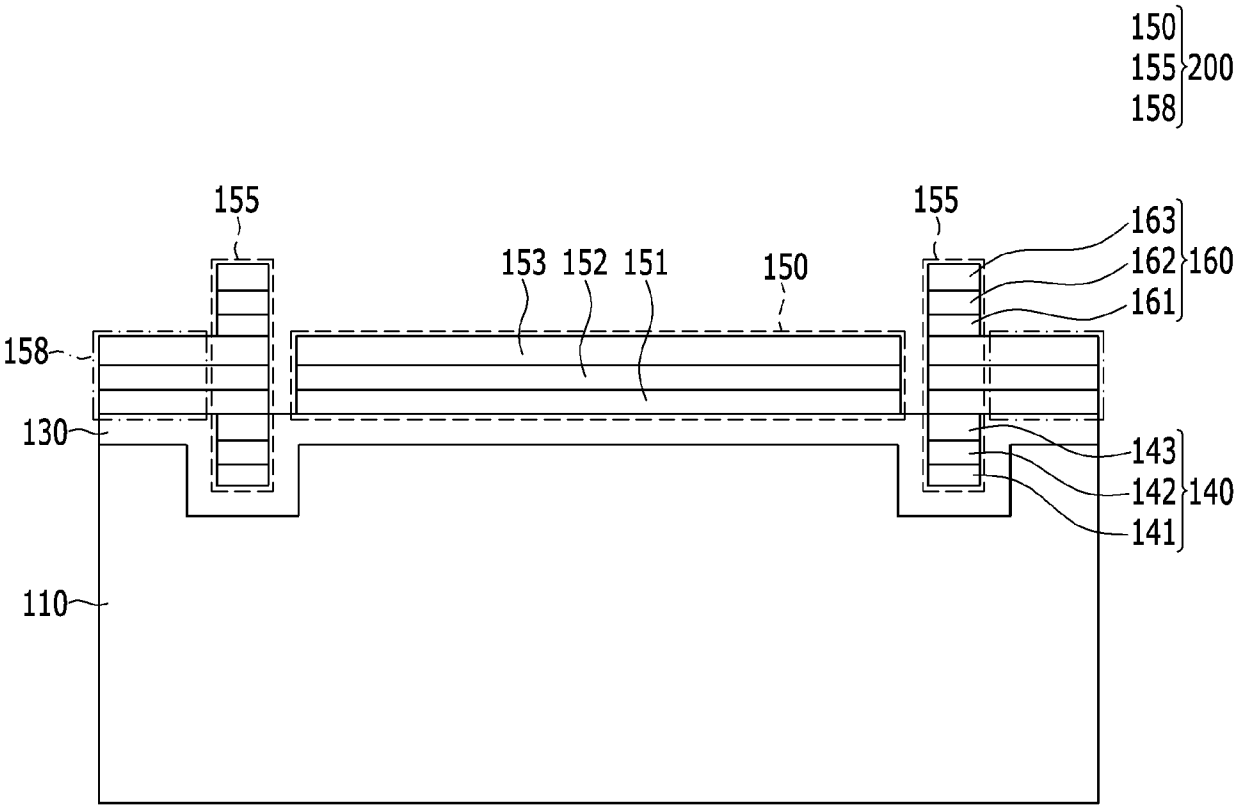

Referring to FIG. 6, a second piezoelectric portion 160 may be formed on the second insulation film 153 and may include a second piezoelectric lower electrode 161, a piezoelectric layer 162 and a second piezoelectric upper electrode 163. The second piezoelectric portion 160 may be formed at a position opposite to the first piezoelectric portion 140. The second piezoelectric portion 160 may be formed by forming a second piezoelectric lower electrode film, a second piezoelectric film, and a second piezoelectric upper electrode film on the second insulation film 153 in succession and patterning the second piezoelectric lower electrode film, the second piezoelectric film and the second piezoelectric upper electrode film. The second piezoelectric film may be formed of a piezoelectric material (e.g., lead zirconate titanate (PZT), barium titanate ($BaTiO_3$), and Rochelle salt).

The vibration unit 200 may formed to include first portion, the second portion 155, and the third portion 158. Referring to FIG. 2, the first portion 150 and the third portion 158 may be spaced from each other, and the second portion 155 may be connected between the first portion 150 and the third portion 158. Each of the first portion 150 and the third portion 158 may include the first insulation film 151, the vibration film 152 and the second insulation film 153. The second portion 155 may include the first insulation film 151, the vibration film 152, and the second insulation film 153. In addition, the second portion 155 may further include a first piezoelectric portion 140 formed on an underside (e.g., a bottom side) of the first insulation film 151 and a second piezoelectric portion 160 formed on the second insulation film 153.

Figure 7:
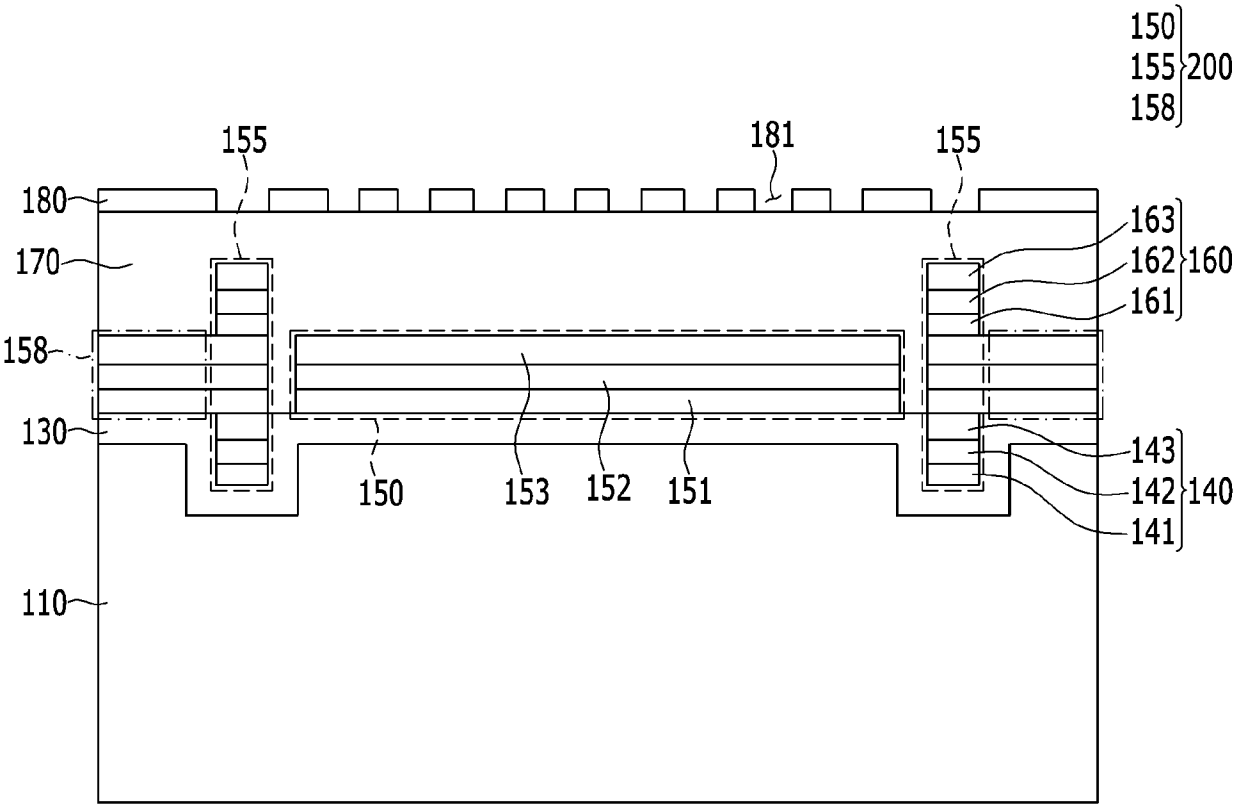

Referring to FIG. 7, after forming a sacrificial layer 170 on the vibration unit 200, a fixed electrode 180 may be formed to include a plurality of air inlets 181. The sacrificial layer 170 may be formed of a photoresistant material. The photoresistant material may have a stable structure thermally and mechanically in view of process and may be removed, more easily. Since the sacrificial layer 170 is formed of such a photoresistant material, the sacrificial layer 170 may be formed in a variety of shapes. Moreover, the material of the sacrificial layer 170 is not limited thereto, but may be formed of silicon oxide or silicon nitride. The fixed layer 180 including the plurality of the air inlets 181 may be formed by patterning after forming a metal layer on the sacrificial layer 170. Accordingly, the patterning of the metal layer may be executed by forming the photoresistant layer on the metal layer, patterning the photoresist layer with exposure and development to form a photoresistant layer pattern, and etching the metal layer using the photoresist layer pattern as a mask.

Referring to FIG. 1, a penetration aperture 120 may be formed within the substrate 110, and a portion of the sacrificial layer 170 may be removed to form an air layer 171 and a supporting layer 172. The penetration aperture 120 may expose the first portion 150 and the second portion 155 of the vibration unit 200. The penetration aperture 120 may be formed by dry or wet etching of a back side of the substrate 110. A portion of the oxide film 130 may be etched during the etching of the back side of the substrate 110, to expose the first portion 150 and the second portion 155 of the vibration unit 200.

The sacrificial layer 170 may be removed with wet etching, in which a wet etchant is used through the air inlets 181. The sacrificial layer 170 may be removed by a dry method (e.g., $O_2$ plasma ashing) via the air inlets 181. As a portion of the sacrificial layer 170 is removed with the wet or dry removal method, the air layer 171 may be formed between the fixed electrode 180 and the first portion 150 and the second portion 155 of the vibration unit 200, and the sacrificial layer 170 may form a supporting layer 172, which supports the fixed electrode 180. The supporting layer 172 may be formed on the third portion 158 of the vibration unit 200.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

110: substrate
111: recess
120: penetration aperture
130: oxide film
140: first piezoelectric portion
150: first portion
155: second portion
158: third portion
160: second portion
170: sacrificial layer
171: air layer
172: supporting layer
180: fixed electrode
181: air inlet
200: vibration unit

What is claimed is:

1. A microphone, comprising:
a substrate that includes a penetration aperture;
a vibration unit disposed over the substrate to cover the penetration aperture; and
a fixed electrode disposed over, and spaced from, the vibration unit,
wherein the vibration unit includes:
a first portion and a second portion disposed over the penetration aperture, and
a third portion disposed on the substrate,
wherein the first portion and the third portion are spaced from each other, and
wherein the second portion is connected between the first portion and the third portion, and includes a first piezoelectric portion and a second piezoelectric portion.

2. The microphone of claim 1, wherein each of the first portion, the second portion and the third portion include:
a first insulation film;
a second insulation film; and
a vibration film disposed between the first insulation film and the second insulation film.

3. The microphone of claim 2, wherein the first piezoelectric portion is disposed on an underside of the first insulation film, and the second piezoelectric portion is disposed on the second insulation film.

4. The microphone of claim 3, wherein the first piezoelectric portion includes:
a first piezoelectric lower electrode;
a first piezoelectric upper electrode; and
a first piezoelectric layer disposed between the first piezoelectric lower electrode and the first piezoelectric upper electrode.

5. The microphone of claim 4, wherein the second piezoelectric portion includes:
a second piezoelectric lower electrode;
a second piezoelectric upper electrode; and
a second piezoelectric layer disposed between the second piezoelectric lower electrode and the second piezoelectric upper electrode.

6. The microphone of claim 2, wherein the vibration film is formed of polysilicon or a conductive material.

7. The microphone of claim 1, wherein the substrate is formed of silicon.

8. The microphone of claim 1, further comprising:
a supporting layer disposed on the third portion to support the fixed electrode.

* * * * *